United States Patent [19]

Krebs

[11] Patent Number: 4,641,614

[45] Date of Patent: Feb. 10, 1987

[54] STARTER DEVICE FOR AN INTERNAL COMBUSTION ENGINE

[75] Inventor: Gerhard Krebs, Waiblingen, Fed. Rep. of Germany

[73] Assignee: Andreas Stihl, Waiblingen, Fed. Rep. of Germany

[21] Appl. No.: 767,181

[22] Filed: Aug. 19, 1985

[30] Foreign Application Priority Data

Aug. 22, 1984 [DE] Fed. Rep. of Germany ..... 3430793

[51] Int. Cl.[4] ..... F02N 1/00

[52] U.S. Cl. ..... 123/185 BA; 123/185 A

[58] Field of Search ..... 123/179 R, 179 SE, 179 CC, 123/185 R, 185 A, 185 B, 185 BA, 185 BB; 74/6

[56] References Cited

U.S. PATENT DOCUMENTS

| | | | |
|---|---|---|---|
| 3,127,884 | 4/1964 | Rice | 123/185 BA |
| 3,252,452 | 5/1966 | Burkett et al. | 123/185 A |
| 4,127,098 | 11/1978 | Frers et al. | 123/185 BA |
| 4,422,417 | 12/1983 | Obermayer | 123/185 B |
| 4,492,190 | 1/1985 | Greenwood et al. | 123/185 BA |

*Primary Examiner*—Willis R. Wolfe, Jr.
*Attorney, Agent, or Firm*—Walter Ottesen

[57] ABSTRACT

A starter device is disclosed for an internal combustion engine of a motor-driven chain saw. The starter device includes a rotor which is secured on a bearing pin by means of a spring clip. The legs of this spring clip extend partially parallel to each other and define an end portion and a guiding portion adjacent to the bearing pin. The rotor has also a pawl pivotable about a pivot axis parallel to the axis of rotation of the rotor. When the internal combustion engine is started, the pawl engages teeth formed on an inner wall surface of a fan wheel. Between its pivot axis and its free end, the pawl has a pawl pin projecting over the pawl and guided in the guiding portion of the spring clip. In the direction of rotation of the fan wheel, the pawl pin comes into contact with one spring leg ahead of a plane connecting the axis of rotation of the rotor with the pivot axis of the pawl, whereby a force component directed in the rotational direction of the fan wheel acts on the spring clip loading the pawl pin in the opposite direction. In this way, the pawl is securely held in its stop position by the spring clip which prevents the pawl from inadvertently pivoting outwardly while the engine is running and engaging the flywheel teeth which could otherwise impair the functional safety of the device.

7 Claims, 4 Drawing Figures

STARTER DEVICE FOR AN INTERNAL COMBUSTION ENGINE

FIELD OF THE INVENTION

The invention relates to a starter device for an internal combustion engine of an apparatus such as a portable handheld chain saw. The starter device includes a rope rotor which is mounted on a bearing pin with a spring clip. The spring clip has legs extending parallel to each other. The legs define an end and guide portion which continue from the bearing pin. A pawl is pivotably attached to a pivot pin which is parallel to the rotational axis of the rope rotor. The pawl comes into engagement with teeth formed on the inside wall surface of a fan wheel and has a pawl pin formed thereon which is guided in the guide portion of the spring clip and lies at a contact position against one of the legs of the latter.

BACKGROUND OF THE INVENTION

U.S. Pat. No. 4,127,098 discloses an arrangement wherein the legs of the spring, in the region of their guiding portions, extend parallel to each other over the entire length. The point of contact of the pawl pin is in the direction of rotation of the fan wheel behind a plane between the axis of rotation of the rotor and an axis of the pawl pin which defines a guide pin. After starting and during operation, the spring clip may thus rotate counterclockwise as a consequence of the occurring vibrations. This can cause the pawl to pivot radially outwardly and thereby engage the teeth of the fan wheel rotating at high speed. This causes wear of the pawl end and eventually shortens the pawl such that in the starting process it will pivot outwardly by a correspondingly larger angle which may result in breakage of the rotor or a failure of the pawl to engage with the teeth. As a result, the tool such as a chain saw or the like cannot be started.

SUMMARY OF THE INVENTION

It is an object of the invention to configure a starter device of the kind referred to above so that after starting and during the operation of the tool, the pawl is held in a secured position out of mesh with the tool component.

The starter device according to the invention is for an internal combustion engine of an apparatus such as a portable handheld chain saw or the like. The apparatus includes a component connected to the crankshaft of the engine so as to transmit a starting torque thereto in a predetermined rotational direction. The component can, for example, be a fan wheel.

The starter device includes a bearing pin defining a rotational axis and being mounted on the apparatus; a rope rotor having a starter rope wound thereon and being rotatably mounted on the bearing pin so as to be rotatable about the axis; teeth means formed on the component connected to the crankshaft; a spring clip having two mutually adjacent legs conjointly defining an end portion for holding the clip to the bearing pin and the rope rotor on the bearing pin, the mutually adjacent legs also conjointly defining a guide portion extending outwardly from the end portion; a pawl having an outer free end and being pivotally mounted on the rope rotor so as to pivot outwardly about a pivot axis parallel to the rotational axis for engaging the teeth means with the free end to impart a torque to the component when the rotor is actuated by pulling the starter rope from the rope rotor; the pawl having a guide member formed thereon for engaging the guide portion for guiding the pawl in its pivotal movement between a stop position whereat the pawl is disengaged from the teeth means and the guide member lies in contact with one of the legs of the guide portion at a predetermined contact location on the one leg and an outward position whereat the pawl is engaged with the teeth means; and, the contact location being disposed ahead of a predetermined plane in the rotational direction, the predetermined plane connecting and extending through the rotational axis and the pivot axis.

According to a feature of the invention, a force component acts upon the spring clip in the direction of rotation of the tool component to load the pawl pin, which defines a guide pin, in the opposite direction. In this way, the pawl is held securely in its stop position by the spring clip thereby preventing the pawl from inadvertently pivoting outwardly and engaging the teeth. The starter device of the invention permits a very simple and inexpensive manufacture since it does not require additional components for securing the guide pin and the pawl. For example, the position of the pivot point of the pawl pin on the leg of the spring clip as provided by the invention may be accomplished by providing the leg with an outwardly bent portion or the like for holding the guide pin and thus the pawl securely in position.

Further advantages of the invention will become apparent from the subsequent description, the drawing and the appended claims.

BRIEF DESCRIPTION OF THE DRAWING

An embodiment of the invention will now be described in more detail with reference to the drawing wherein.

DESCRIPTION OF THE PREFERRED EMBODIMENT OF INVENTION

Figure 1:
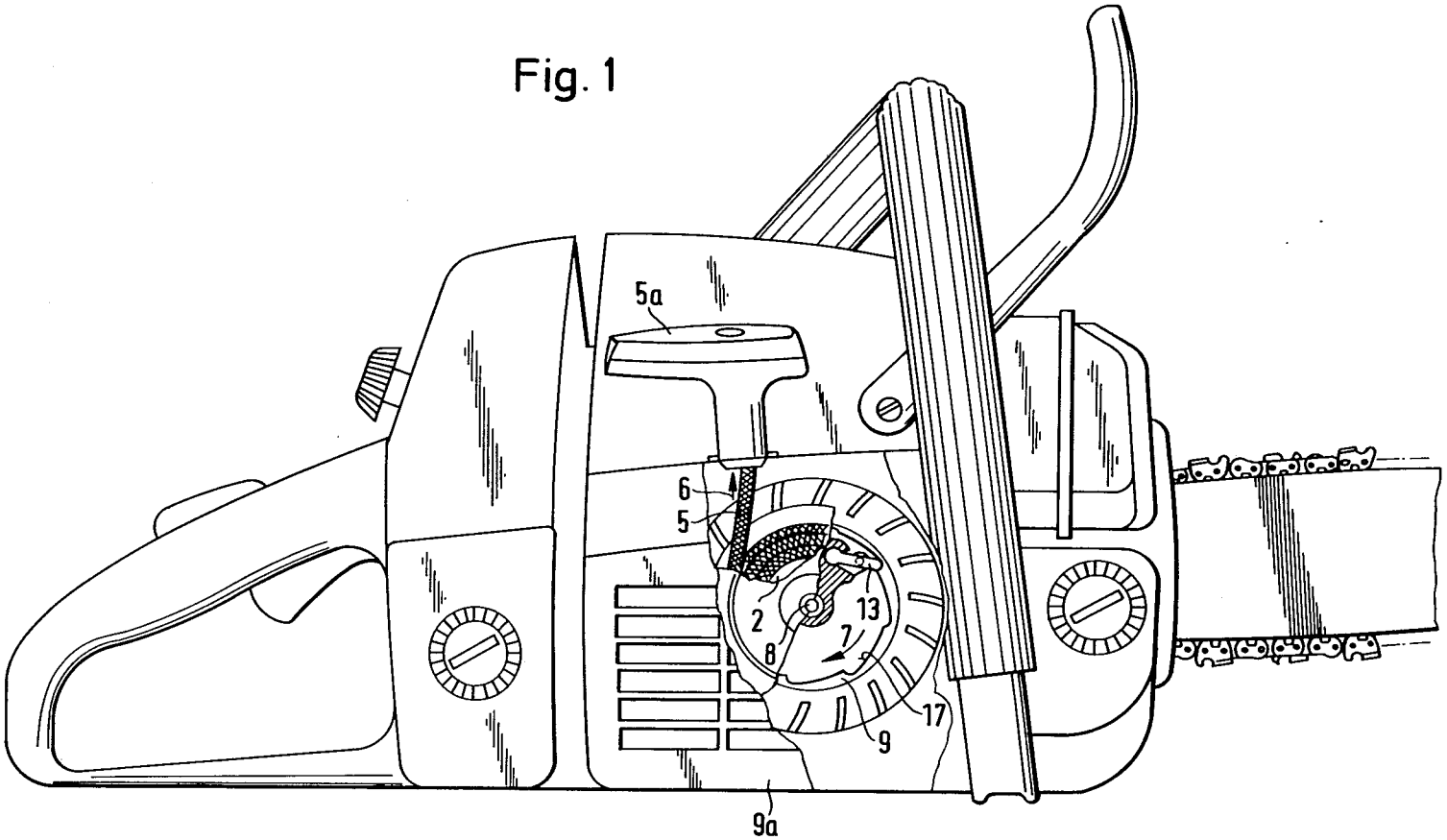
FIG. 1 shows part of a motor-driven chain saw with a portion of the housing broken away to show a side elevation view of a starter device of the invention.
Figure 3:
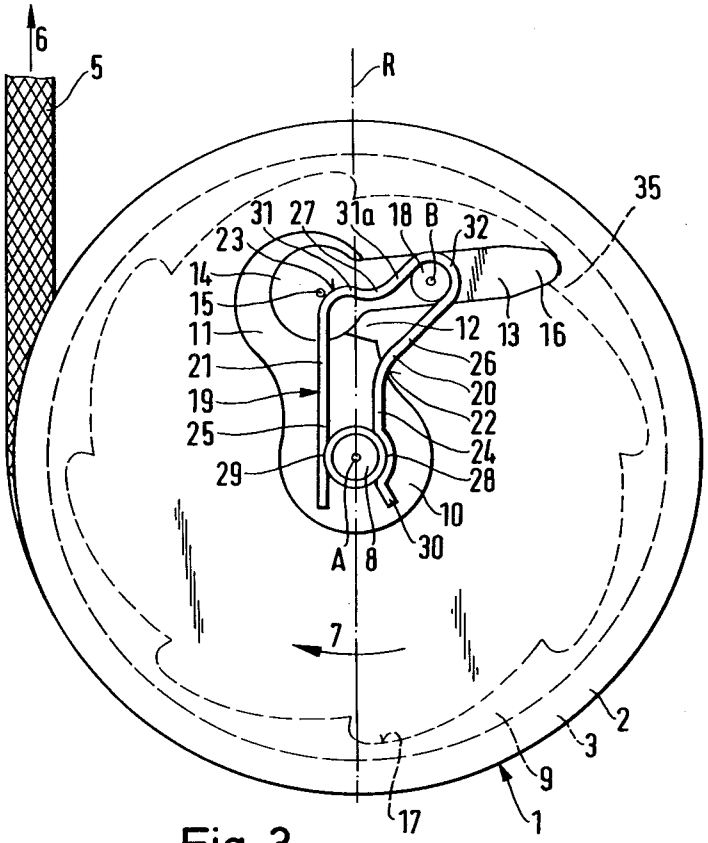
FIG. 3 is a view of the starter device of FIG. 2 during starting.
Figure 2:
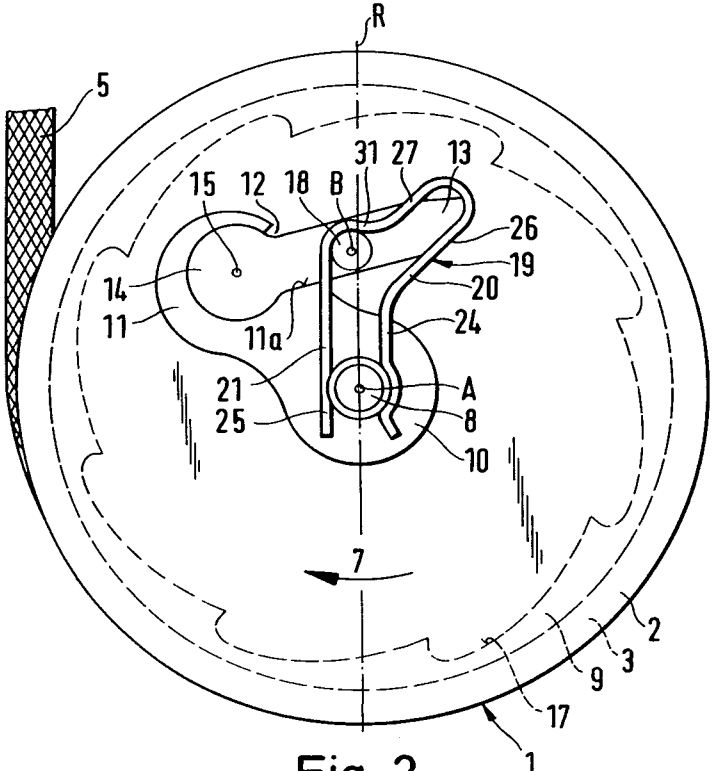
FIG. 2 is a plan view of the inside of the rope rotor of the starter device of the invention in the stop position with the internal combustion engine running.

The starter device 1 of FIGS. 2 and 3 is manually actuated to start an internal combustion engine of a portable motor-driven chain saw as shown in FIG. 1. The starter device 1 has a rope rotor 2 with a peripheral slot 3 in which a starter rope 5 is received. A starter grip 5*a* is connected to rope 5 at its free end. The rope 5 unwinds from the rotor 2 when it is pulled in the direction of the arrow 6 in FIGS. 1 and 3. In this process, the rotor rotates clockwise against the force of a return spring (not shown) in the direction of the arrow 7 in FIG. 3.

The rope rotor 2 is rotatably mounted on a bearing pin 8 fastened in a housing 9*a* of a tool component in a manner known per se. In the embodiment shown, the rope rotor is mounted in the housing of a fan wheel 9 of the motor-driven chain saw so that the longitudinal axis A of the bearing pin 8 forms the axis of rotation of the rotor 2. The bearing pin 8 projects with its end over the rotor 2 and has at this end an annular slot (not shown) for holding a spring clip 19.

On its rear side remote from the fan wheel 9, the rotor 2 has a projecting hub 10 cast integrally therewith. The hub 10 blends into a crescent-shaped receiving portion 11 which defines a recess 12 curved to form a segment of a circle. The recess serves to journal a pawl 13 having at its one end a rounded, enlarged bearing portion 14 which is likewise curved to form a segment of a circle and adapted to the recess 12. The bearing portion 14 is in positive form-fitting engagement with the recess 12 of the receiving portion 11 thereby enabling the pawl 13 to pivot radially outwardly about its pivot axis 15, which contains the center of curvature of the bearing portion 14, when the rotor 2 rotates in the direction of rotation 7 under the action of the pulling force on the rope 5 when the starter device 1 is operated.

As the pawl 13 pivots, its tip 16 (FIG. 3) comes into engagement with the inside teeth 17 of the fan wheel 9 which, on the side close to the engine, has a recess for accommodating a flange (not shown) connected with a crankshaft of the internal combustion engine.

With the pawl 13 engaged as shown in FIG. 3, it takes the fan wheel 9 along in its movement in the direction of rotation 7 until the internal combustion engine starts. Then the starter grip 5*a* is released, enabling the rotor 2 to rotate back into its initial position under the force of the return spring, whereby the pawl 13 pivots back radially inwardly to its disengaged position (FIG. 2).

Lengthwise approximately in its center, the pawl 13 has a pin 18 of preferably circular cross-section projecting at a right angle over its one outer side and preferably integrally formed with the pawl 13. The pin 18 serves as a guide pin for the spring clip 19 fastened to the bearing pin 8. The spring clip is preferably of a spring-steel wire of round cross-section and bent approximately in the shape of a hairpin. The spring clip 19 has two parallel legs 20, 21 with kinks 22, 23 at about half-length thereby forming end portions 24, 25 abutting the bearing pin 8 and forming guiding portions 26, 27 extending at obtuse angles thereto. The end portions 24, 25 terminate in holding sections 28, 29 which engage the annular slot of the bearing pin 8. The one holding section 28 of the end portion 24 is curved on the arc of a circle in correspondence with the curvature of the annular slot and continues in an end 30 extending away from the other end portion 25, so that the legs 20, 21 can be easily spread to mount the spring clip on the bearing pin 8. With the spring clip 19 mounted, the holding sections 28, 29 are resiliently held to the bottom of the annular slot of the bearing pin 8 so that the spring clip is frictionally engaged with the latter. The guiding portion 26 forms an angle of, for example, about 45° with a radial plane R containing the axis of rotation A of the rotor 2 and extending between the end portions 24, 25 of the spring legs 20, 21 so as to be parallel thereto; in addition, the guiding portion 26 forms an obtuse angle of preferably about 135° with the corresponding end portion 24. The acute angle may also be greater, for example, 80°.

The one guiding portion 27 has an angular segment 31 bent outwardly from the axis of rotation A of the rotor 2 and from the spring clip portion 26. It serves to secure the pawl pin 18. The angular segment 31 joins directly the kink 23 and the end portion 25 and extends at approximately a right angle to the end portion 25 and at an obtuse angle to a segment 31*a* of the guiding portion 27. The legs 20, 21 are connected by a curved segment 32 joined by the segment 31*a* which forms an angle of about 130° with the angular segment 31. In addition, the angular segment 31 forms a stop against which the pawl pin 18 abuts in the stop position when the internal combustion engine is running.

FIG. 2 also shows the initial position of the starter device with the internal combustion engine at standstill. Pulling the starter rope 5 causes the rotor 2 to rotate in the direction of the arrow 7. The pawl 13 rests against an abutment surface 11*a* of the receiving portion 11 and is thereby made to follow this rotational movement. The pawl pin 18 will move onto the guide portion 26 of the spring clip. The pawl pin 18 slides outwardly along the inclined guiding portion 26 of the spring clip 19 with the pawl 13 pivoting about its axis 15 into the position shown in FIG. 3. The free end 16 of the pawl 13 comes into engaging contact with the teeth 17 of the fan wheel 9 which too is taken along in direction of arrow 7. In this position of engagement, the spring clip 19 will be caused to follow the direction of rotation 7.

Because the fan wheel 9 is coupled to the crankshaft of the internal combustion engine in a non-rotatable relationship thereto, the crankshaft is cranked to the speed required for starting the engine. As soon as the engine is running, the fan wheel 9 will overtake the rotor 2 in the direction of rotation 7, while the rotor will rotate back into its initial position under the force of its loaded return spring. This rotational return movement of rotor 2 causes the pawl pin 18 to slide along the guiding portion 27 back into its initial position as shown in FIG. 2 and the pawl 13 will become disengaged from the inside teeth 17 of the fan wheel.

Figure 4:
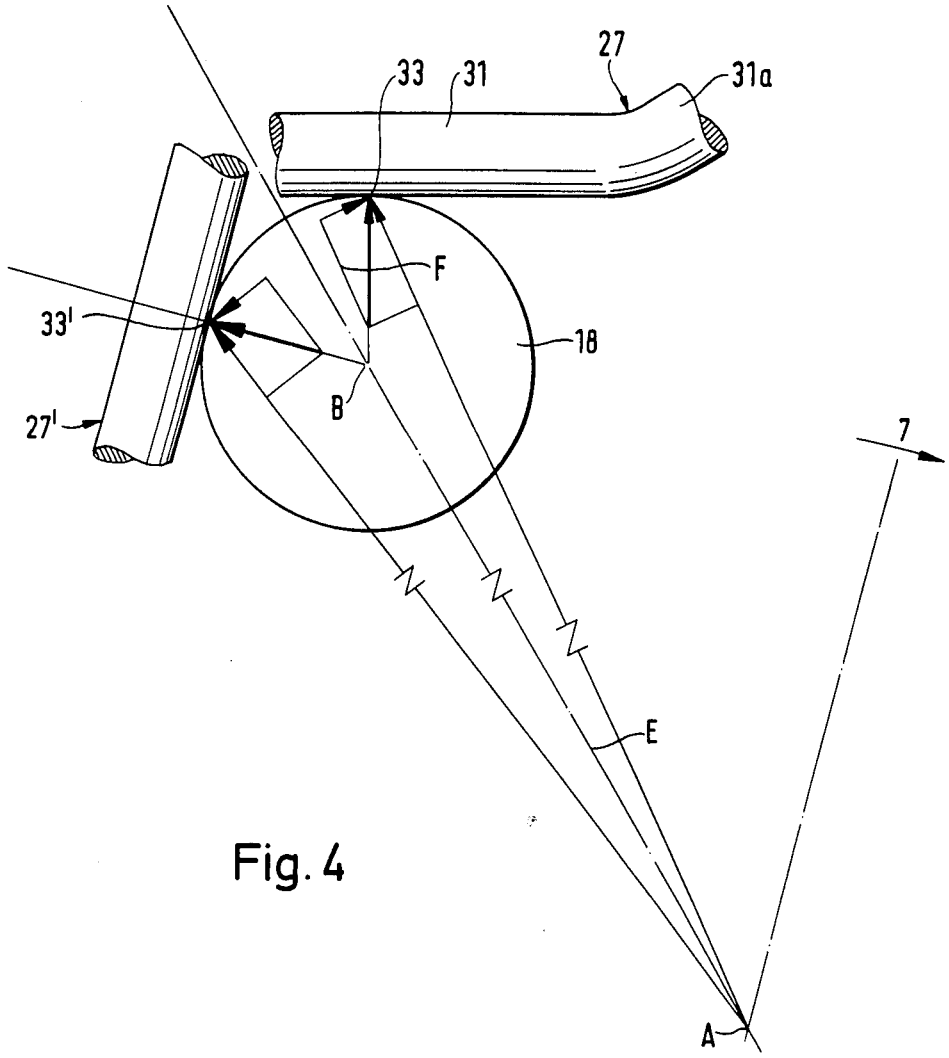
FIG. 4 is a schematic showing the force components which develop during the operation of the internal combustion engine and which are applied by the guide pin of the pawl of the rope rotor to a leg of a conventional spring clip and to a leg of a spring clip configured according to a feature of the starter device of FIGS. 2 and 3 of the invention.

As shown in FIG. 4, the angular segment 31 of the spring clip 21 is configured such that the point of contact 33 between the pawl pin 18 and the segment 31 is in the direction of fan wheel rotation 7 ahead of a plane E connecting the rotational axis A of the bearing pin 8 with the axis B of the pawl pin 18. As shown in the parallelogram of forces of FIG. 4, a force F will thereby act on the guiding portion 27 and therefore on the spring clip 19 in the direction of fan wheel rotation 7; this force causes the spring clip 19 to rotate in the same direction. As a result, the pawl pin 18 will be held in the stop position shown in FIG. 2 in which the pawl pin 18, under the force acting on the pawl 13 with the motor-driven chain saw in operation, is preferably retained in positive engagement with the curved portion between the end portion 25 and the angular segment 31 of the resilient leg 21 of the spring clip 19. The pawl pin 18 will become stabilized in this curved portion, whereby the spring clip 19 is safely prevented from rotating in the direction of fan wheel rotation 7 and from releasing the pawl 13 which would otherwise enable it to move radially outwardly against the fan wheel teeth causing possible damage to the fan wheel 9.

The left-hand part of FIG. 4 shows the parallelogram of forces for the starter device of U.S. Pat. No. 4,127,098, the point of contact 33' between the pawl pin 18 and the leg 27' is in the direction of fan wheel rotation 7 behind the plane E, so that the spring clip is acted upon by a force opposite to the direction of rotation 7. As a result, the spring clip is rotated counterclockwise so that the pawl can move radially outwardly and thereby strike against the teeth of the fan wheel.

When the internal combustion engine is started, the pawl pin 18 is guided between the guiding portion 26 and the segment 31*a* of the guiding portion 27 of the spring clip 19 (FIG. 3). When the rope rotor 2 is spun in the direction of rotation 7 by pulling the starter rope 5, the pawl pin 18 will move towards the guiding portion 26 of the spring clip 19 and, because of the inclined position of the guiding portion 26, the pawl pin 18 will be moved further in the direction of the curved segment 32 of the spring clip. In this way, the pawl 13 will be pivoted counterclockwise radially outwardly about its pivot axis 15. As the rotor 2 continues to rotate, the pawl tip 16 will be brought into engagement with a tooth 35 of the inside teeth 17 of the fan wheel 9 thereby causing the fan to follow the direction of rotation 7.

Because the pawl pin 18 is guided on the guiding portion 26 during starting, the internal combustion engine can be started easily.

Keeping the pawl 13 out of mesh with the teeth of the fan wheel can be accomplished easily and at low cost because, after the internal combustion engine is started, the pawl pin 18 is secured solely by the curvature between the end portion 25 and the segment 31 of the guiding portion 27 of the spring leg 21. Additional parts are not necessary for this purpose. Since during starting the pawl pin 18 has to be moved only along the angular segment 31 of the spring leg 21 and the radially outwardly adjoining part of the opposite guiding portion 26 of the spring leg 20, the amount of travel of the pawl pin 18 is extremely short when the starter device is operated, so that the pawl 13 engages the fan wheel 9 immediately after the starter rope 5 is pulled off the rotor 2, thereby starting the internal combustion engine.

It is understood that the foregoing description is that of the preferred embodiments of the invention and that various changes and modifications may be made thereto without departing from the spirit and scope of the invention as defined in the appended claims.

What is claimed is:

1. A starter device for an internal combustion engine of an apparatus such as a portable handheld chain saw, the engine having a crankshaft and the apparatus including a component connected to the crankshaft so as to transmit a starting torque thereto in a predetermined rotational direction, the starter device comprising:

a bearing pin defining a rotational axis and being mounted on said apparatus;

a rope rotor having a starter rope wound thereon and being rotatably mounted on said bearing pin so as to be rotatable about said axis;

teeth means formed on said component;

a spring clip having two mutually adjacent legs conjointly defining an end portion for holding said clip to said bearing pin and said rope rotor on said bearing pin, said mutually adjacent legs also conjointly defining a guide portion extending outwardly from said end portion;

a pawl having an outer free end and being pivotally mounted on said rope rotor so as to pivot outwardly about a pivot axis parallel to said rotational axis for engaging said teeth means with said free end to impart a torque to said component when said rotor is actuated by pulling said starter rope from the rope rotor;

said pivot axis and said rotational axis conjointly defining a predetermined plane;

said pawl having a guide member formed thereon for engaging said guide portion for guiding said pawl in its pivotal movement between a stop position whereat said pawl is disengaged from said teeth means and said guide member lies in contact with one of said legs of said guide portion at a predetermined contact location on said one leg and an outward position whereat said pawl is engaged with said teeth means; and, said one leg of said guide portion being curved to place said contact location ahead of said predetermined plane when viewed in said rotational direction so as to cause the force exerted by said guide member to act upon said one leg in said rotational direction thereby rotating said spring clip in said direction and holding said guide member in said stop position after said engine is started and rotating.

2. The starter device of claim 1, said component being a fan wheel having an inside wall surface facing toward said rope rotor, said teeth means being a set of teeth formed on said inside wall surface; said guide member being a guide pin extending outwardly from said pawl.

3. A starter device for an internal combustion engine of an apparatus such as a portable handheld chain saw, the engine having a crankshaft and the apparatus including a component connected to the crankshaft so as to transmit a starting torque thereto in a predetermined rotational direction, the starter device comprising:

a bearing pin defining a rotational axis and being mounted on said apparatus;

a rope rotor having a starter rope wound thereon and being rotatably mounted on said bearing pin so as to be rotatable about said axis;

said component being a fan wheel having an inside wall surface facing toward said rope rotor;

a set of teeth formed on said inside wall surface;

a spring clip having two mutually adjacent legs conjointly defining an end portion for holding said clip to said bearing pin and said rope rotor on said bearing pin, said mutually adjacent legs also conjointly defining a guide portion extending outwardly from said end portion;

a pawl having an outer free end and being pivotally mounted on said rope rotor so as to pivot outwardly about a pivot axis parallel to said rotational axis for engaging said teeth with said free end to impart a torque to said component when said rotor is actuated by pulling said starter rope from the rope rotor;

said pawl having a guide pin formed thereon and extending outwardly therefrom for engaging said guide portion for guiding said pawl in its pivotal movement between a stop position whereat said pawl is disengaged from said teeth and said guide pin lies in contact with one of said legs of said guide portion at a predetermined contact location on said one leg and an outward position whereat said pawl is engaged with said teeth;

said contact location being disposed ahead of a predetermined plane in said rotational direction, said predetermined plane connecting and extending through said rotational axis and said pivot axis; and, said guide portion of said clip spring being configured to define holding means for holding said pawl in said stop position during the operation of the engine.

4. The starter device of claim 3, said holding means being an abutment for said guide pin.

5. The starter device of claim 4, said holding means being a segment of said one leg, said leg being configured so as to be curved outwardly away from said rotational axis and the other one of said legs of said spring clip.

6. The starter device of claim 4, said holding means being configured so as to latch said guide pin to hold said pawl in said stop position.

7. The starter device of claim 4, said holding means being formed directly next to said end portion.

* * * * *